US007527715B2

(12) United States Patent
Fiot et al.

(10) Patent No.: US 7,527,715 B2
(45) Date of Patent: May 5, 2009

(54) METHOD AND SYSTEM FOR COOLING AN ELECTROLYTIC CELL FOR ALUMINUM PRODUCTION

(75) Inventors: Laurent Fiot, Toronto (AU); Claude Vanvoren, St. Jean de Maurienne (FR); Airy-Pierre Lamaze, Reaumont (FR); Bernard Eygulnent, Grenoble (FR); Jean-Luc Basquin, St. Jean de Maurienne (FR)

(73) Assignee: Aluminum Pechiney, Paris (FR)

( * ) Notice: Subject to any disclaimer, the term of this patent is extended or adjusted under 35 U.S.C. 154(b) by 693 days.

(21) Appl. No.: 10/520,523

(22) PCT Filed: Jul. 7, 2003

(86) PCT No.: PCT/FR03/02098

§ 371 (c)(1),
(2), (4) Date: Sep. 23, 2005

(87) PCT Pub. No.: WO2004/007806

PCT Pub. Date: Jan. 22, 2004

(65) Prior Publication Data

US 2006/0118410 A1 Jun. 8, 2006

(30) Foreign Application Priority Data

Jul. 9, 2002 (FR) ..... 02 08629

(51) Int. Cl.
*C25C 3/10* (2006.01)

(52) U.S. Cl. ..... 204/247.4; 204/247.5

(58) Field of Classification Search ..... 204/247.4, 204/247.5; 205/396

See application file for complete search history.

(56) References Cited

U.S. PATENT DOCUMENTS

| | | | |
|---|---|---|---|
| 1,534,322 | A | 4/1925 | Hoopes et al. |
| 4,087,345 | A | 5/1978 | Sandvik |
| 4,749,463 | A | 6/1988 | Holmen |
| 5,644,608 | A | 7/1997 | Malik |

(Continued)

FOREIGN PATENT DOCUMENTS

| | | |
|---|---|---|
| EP | 0044512 A1 | 1/1982 |

(Continued)

OTHER PUBLICATIONS

Notice of Opposition to a European Patent (EP 1 527 213 B1) mailed Dec. 11, 2008 (14 pages).

(Continued)

*Primary Examiner*—Bruce F Bell
(74) *Attorney, Agent, or Firm*—Banner & Witcoff, Ltd.

(57) ABSTRACT

The invention relates to a cooling method of a igneous electrolytic cell for aluminium production wherein heat transfer fluid droplets (or "divided heat transfer fluid") are produced, preferentially in a confined volume in contact with a specified surface of at least one wall of the shell of the pot of the electrolytic cell, so as to induce the evaporation of all or part of said droplets by contact with said surface and remove the heat from said surface. The invention also relates to a cooling system capable of implementing the cooling method. The invention makes it possible to obtain a high cooling efficiency due to the latent heat of vaporisation of the heat transfer fluid.

40 Claims, 5 Drawing Sheets

U.S. PATENT DOCUMENTS

| | | | | |
|---|---|---|---|---|
| 5,797,274 | A | 8/1998 | Jackaman et al. | |
| 6,251,237 | B1 | 6/2001 | Bos | |
| 2006/0049054 | A1 * | 3/2006 | Van Acker et al. | 205/81 |
| 2008/0251392 | A1 * | 10/2008 | Van Acker | 205/350 |

FOREIGN PATENT DOCUMENTS

| | | | |
|---|---|---|---|
| EP | 0047227 | | 3/1982 |
| FR | 2777574 | | 10/1999 |
| GB | 225494 | | 2/1925 |
| RU | 2058432 | C1 | 4/1996 |
| RU | 1254769 | A | 6/1999 |
| WO | WO8903011 | | 4/1989 |
| WO | WO-01/94667 | | 12/2001 |
| WO | WO0194667 | | 12/2001 |

OTHER PUBLICATIONS

Notice of Opposition Filing (from EPO to Applicant) mailed Dec. 11, 2008 (1 page).

Notice of Opposition and Request to File Observations (from EPO to Applicant) mailed Jan. 15, 2009 (2 pages).

* cited by examiner

METHOD AND SYSTEM FOR COOLING AN ELECTROLYTIC CELL FOR ALUMINUM PRODUCTION

CROSS REFERENCE TO RELATED APPLICATIONS

This application is a §371 National Stage Application of International Application Ser. No. PCT/FR03/002098 filed Jul. 7, 2003 which claims priority to French Application Ser. No. 02/08629filed Jul. 9, 2002.

BACKGROUND OF THE INVENTION

1. Field of the invention

The invention relates to the production of aluminium by means of igneous electrolysis, particularly using the Hall-Heroult electrolysis process, and installations intended for the industrial embodiment of said production. The invention relates more specifically to the control of thermal flows from electrolytic cells and the cooling means used to obtain this control.

2. State of the related art

Metal aluminium is produced industrially by means of igneous electrolysis, i.e. by electrolysis of alumina in solution in a molten cryolite-based bath, referred to as an electrolyte bath, particularly according to the well-known Hall-Heroult process. The electrolyte bath is contained in pots, referred to as "electrolytic pots", comprising a steel shell, the inside of which is lined with refractory and/or insulating materials, and a cathode assembly located at the base of the pot. Anodes are partially immersed in the electrolyte bath. The expression "electrolytic cell" normally refers to the assembly comprising an electrolytic pot and one or more anodes.

The electrolysis current circulating in the electrolyte bath and the liquid aluminium pad via the anodes and the cathode components and which may reach intensities greater than 500 kA, carries out alumina reduction reactions and also makes it possible to maintain the electrolyte bath at a temperature of the order of 950° C. by means of the Joule effect. The electrolytic cell is fed regularly with alumina so as to compensate for the alumina consumption resulting from the electrolysis reactions.

The electrolytic cell is generally controlled such that it is in thermal equilibrium, i.e. the heat dissipated by the electrolytic cell is compensated overall by the heat produced in the cell, which essentially comes from the electrolysis current. The thermal equilibrium point is generally selected so as to achieve the most favourable operating conditions in not only technical, but economic terms. In particular, the possibility to maintain an optimal set-point temperature represents an appreciable saving on the production cost of aluminium due to the maintenance of the current efficiency (or Faraday yield) at a very high value, reaching values greater than 95% in the most efficient plants.

The thermal equilibrium conditions depend on the physical parameters of the cell (such as the dimensions and nature of the constituent materials or the electrical resistance of the cell) and the cell operating conditions (such as the bath temperature or the electrolysis current). The cell is frequently constituted and run so as to induce the formation of a ridge of solidified bath on the lateral walls of the pot, which particularly makes it possible to inhibit corrosion of the linings of said walls by the liquid cryolite.

In order to be able to achieve very high electrolysis current values in restricted electrolytic pot volumes, it is known to equip the electrolytic cells with specific means to evacuate and dissipate, possibly in a controlled manner, the heat produced by the electrolytic cells.

In particular, in order to favour solidified bath ridge formation more specifically, it is known, through the American patent U.S. Pat. No. 4,087,345, to use a shell equipped with stiffeners and a reinforcement frame constituted so as to favour the cooling of the sides of the pot by natural convection of ambient air. These static devices do not lend themselves easily to precise thermal flow control.

It has also been proposed, through the patent application EP 0 047 227, to reinforce the heat insulation of the pot and equip it with heat pipes equipped with heat exchangers. The heat pipes pass through the shell and the heat insulator and are incorporated in the carbonaceous parts, such as the edge slabs. This solution is relatively complex and costly to implement and also results in significant modifications of the pot.

The French patent application FR 2 777 574 (corresponding to the American patent U.S. Pat. No. 6,251,237), held by Aluminium Pechiney, discloses an electrolytic cell cooling device using air blowing with localised jets distributed around the shell. However, the very high efficiency of this device is limited by the intrinsic heat capacity of the heat transfer fluid.

Having noted the absence of sufficiently satisfactory known solutions, the applicant set an objective to find effective and adaptable means to evacuate and dissipate the heat produced by the electrolytic cell, which can easily be implemented and does not require significant modification of the cell, particularly of the shell, a large infrastructure, or redhibitory additional operating costs. With a view to use the same in both existing plants and new plants, the applicant particularly researched means which make it possible to modify the power of the cells, which can be adapted easily to various cell types or at different operating modes of the same cell type, and which lend themselves to industrial installations comprising a large number of cells in series.

SUMMARY OF THE INVENTION

The invention relates to a method of cooling an igneous electrolytic cell for the production of aluminium wherein a heat transfer fluid (or fluid coolant) absorbs the heat from said cell by a change of phase of all or part of said fluid in contact with the cell pot.

More specifically, in the method according to the invention, a "divided heat transfer fluid" (or "divided fluid coolant") is produced, such as droplets of a heat transfer fluid, and all or part of said droplets are placed in contact with the pot shell, so as to induce the vaporisation of all or part of said droplets.

The heat transfer fluid vapour formed by the vaporisation of all or part of said droplets upon contacting the shell may be evacuated by natural ventilation (such as convection), by blowing or by suction.

The vaporisation removes heat from the cell and said heat may then be evacuated with the heat transfer fluid vapour. The divided form of the heat transfer fluid makes it possible to preserve the latent heat of evaporation of the fluid until it comes into contact with the pot shell. The droplets are heated and vaporised, at least partially, in contact with the pot shell and the vapour produced in this way carries a quantity of thermal energy wherein a significant proportion corresponds to the latent heat of evaporation of the fluid.

Therefore, the applicant had the idea of benefiting from the high heat absorption capacity associated with the vaporisation of the droplets to increase the cooling power of the heat transfer fluid considerably. In particular, the formation of heat transfer fluid in divided form in a gas makes it possible to obtain a higher heat conductivity, specific heat and latent heat than the gas alone. The applicant also had the idea that the division or fractionation of the fluid into separate droplets also makes it possible to produce a substantially homogeneous, but discontinuous heat transfer fluid, which breaks, in particular, the electrical continuity of the heat transfer fluid, while preserving a high heat capacity in the heat transfer fluid.

In a preferred embodiment of the invention, the electrolytic cell is equipped with at least one confinement means forming a confined space in the vicinity of a specified surface of at least one of the pot shell walls and heat transfer fluid droplets are produced in said space. The confinement means may possibly be in contact with the shell. It may possibly be contiguous or fixed to the shell or integral therewith.

The invention also relates to a system for cooling an igneous electrolytic cell for the production of aluminium which is characterised in that it comprises at least one means to produce heat transfer fluid droplets, advantageously in the vicinity of the pot shell, and one means to place said droplets in contact with the shell, so as to induce the vaporisation of all or part of said droplets.

The cooling system according to the invention may also comprise means to evacuate the vaporised heat transfer fluid.

In a preferred embodiment of the invention, the cooling system also comprises at least one confinement housing or casing, at least one heat transfer fluid supply means and at least one means to produce droplets of said fluid in said casing.

The confinement casings, which are typically placed at a specified distance from the pot shell favour the contact of the droplets with a specified surface of the shell. They are preferentially placed in the vicinity of the lateral walls of the shell. They may possibly be contiguous or fixed to the walls of the shell or integral therewith.

Said cooling system is capable of implementing the cooling method according to the invention.

The invention also relates to a method to regulate an electrolytic cell intended to produce aluminium by means of igneous electrolysis including a cell cooling method according to the invention.

The invention also relates to an electrolytic cell intended to produce aluminium by means of igneous electrolysis comprising a cooling system according to the invention.

The invention also relates to the use of the cooling method according to the invention to cool an igneous electrolysis aluminium production cell.

The invention also relates to the use of the cooling system according to the invention to cool an igneous electrolysis aluminium production cell.

The invention is particularly applicable to aluminium production by means of the Hall-Héroult process.

The invention makes it possible to reduce the thickness of the inner refractory linings (or "crucible") of electrolytic cell pots, particularly the lateral walls, and increase the internal volume of the crucible able to contain the electrolytic bath accordingly.

DETAILED DESCRIPTION OF A PREFERRED EMBODIMENT

Figure 1:
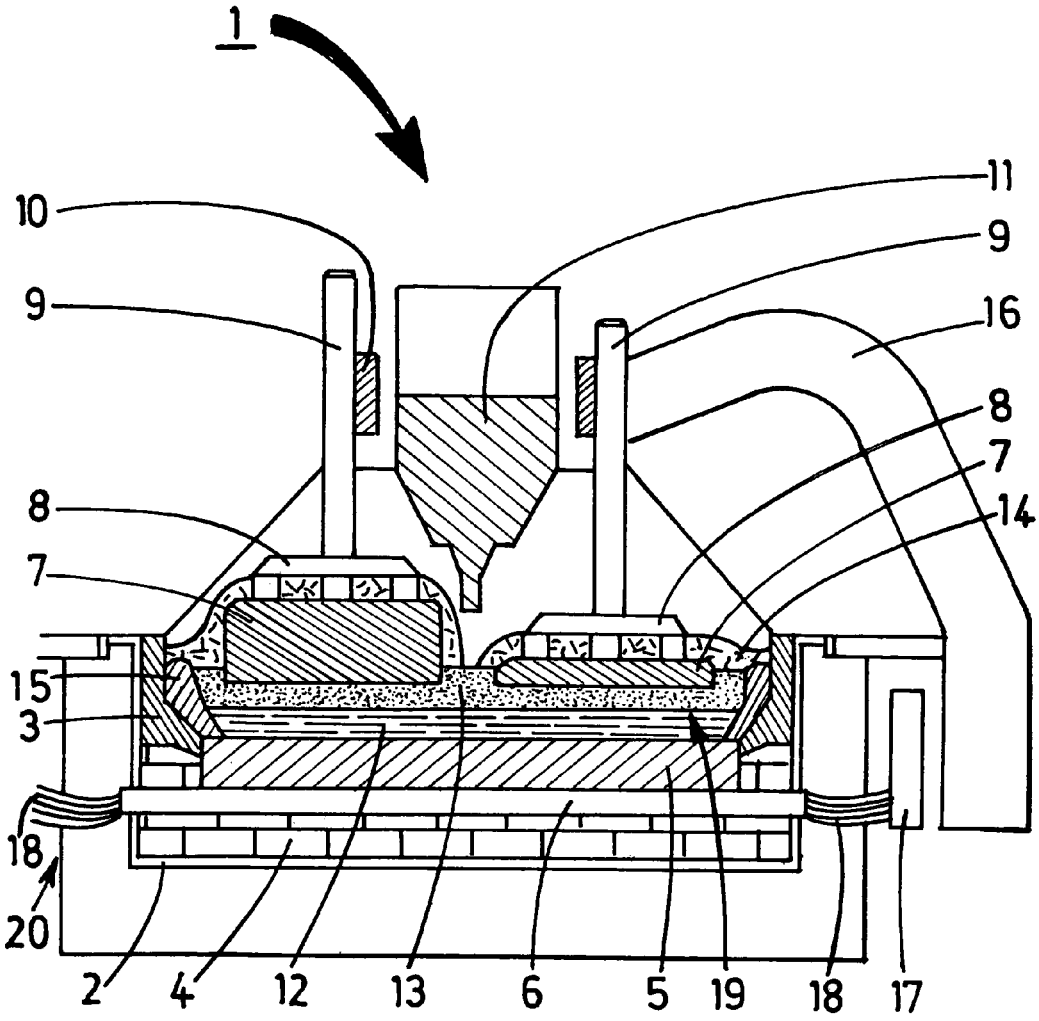
FIG. 1 represents, in a cross-section view, a typical electrolytic cell for aluminium production using prebaked anodes made of carbonaceous material.
Figure 2:
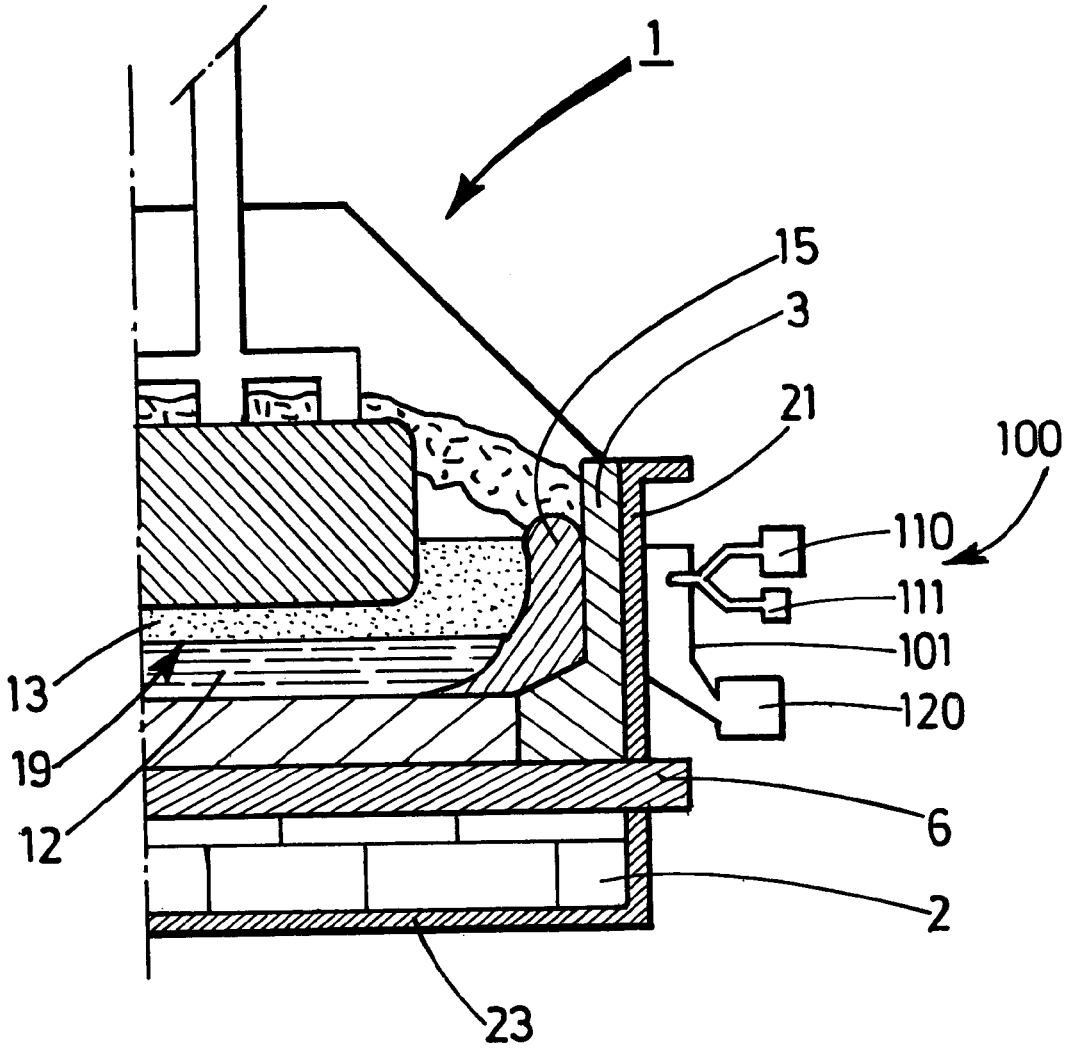
FIG. 2 illustrates schematically in a cross-section view an electrolytic cell comprising a cooling system according to a preferred embodiment of the invention.
Figure 3:
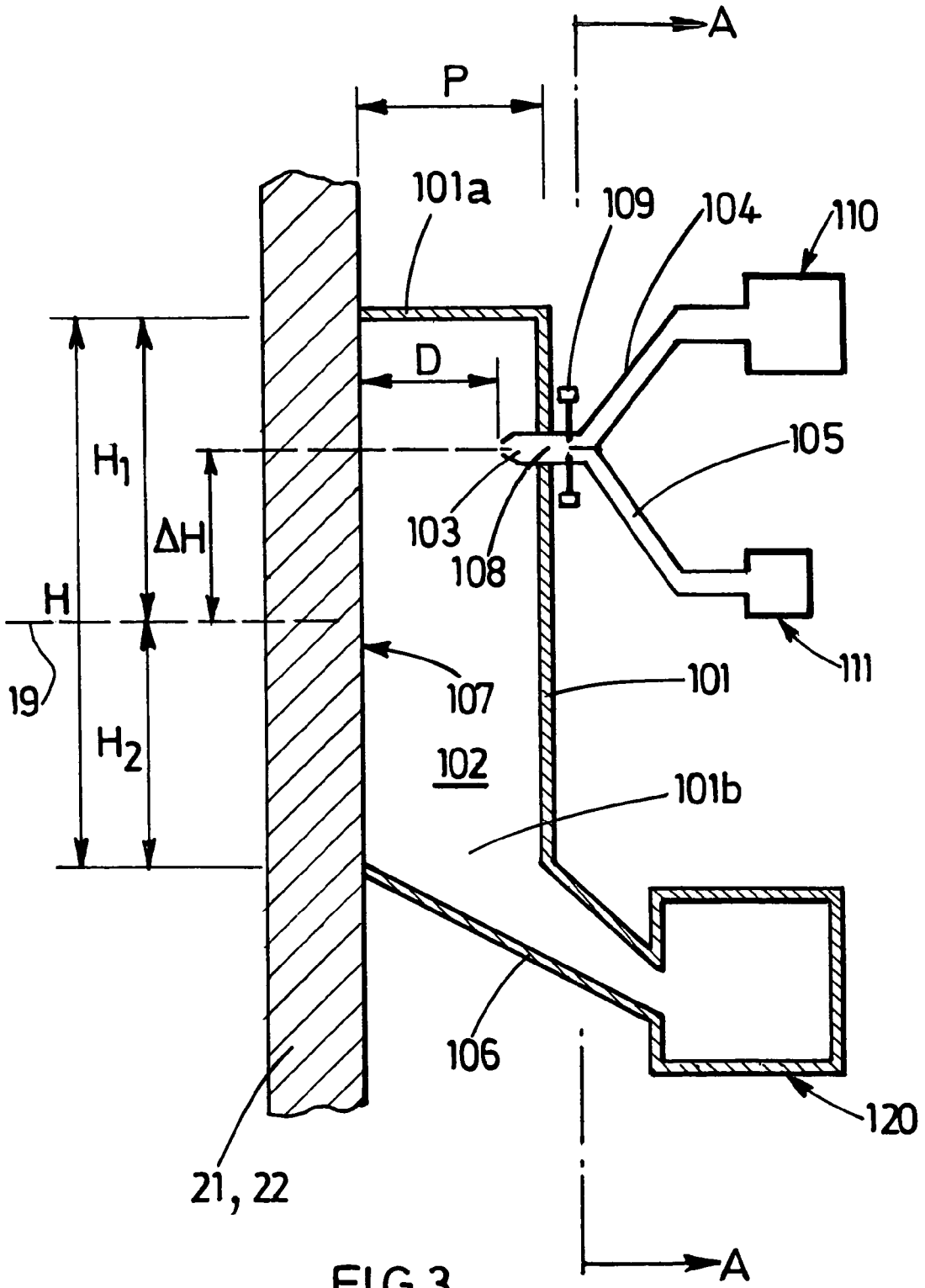
FIG. 3 illustrates schematically in a cross-section view a part of the cooling system according to a preferred embodiment of the invention.
Figure 4:
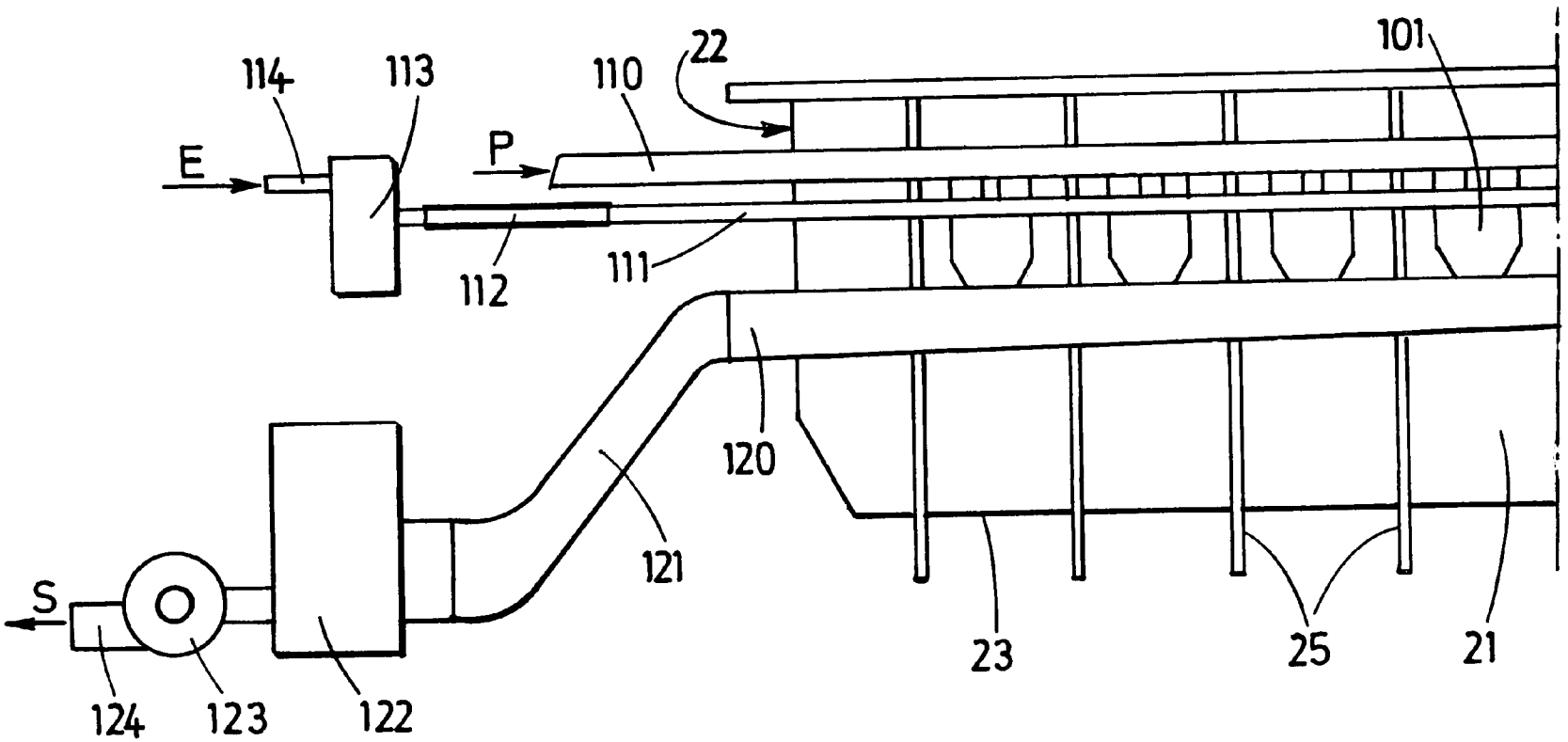
FIG. 4 illustrates schematically in a side view an electrolytic cell pot equipped with a cooling system according to a preferred embodiment of the invention.
Figure 5:
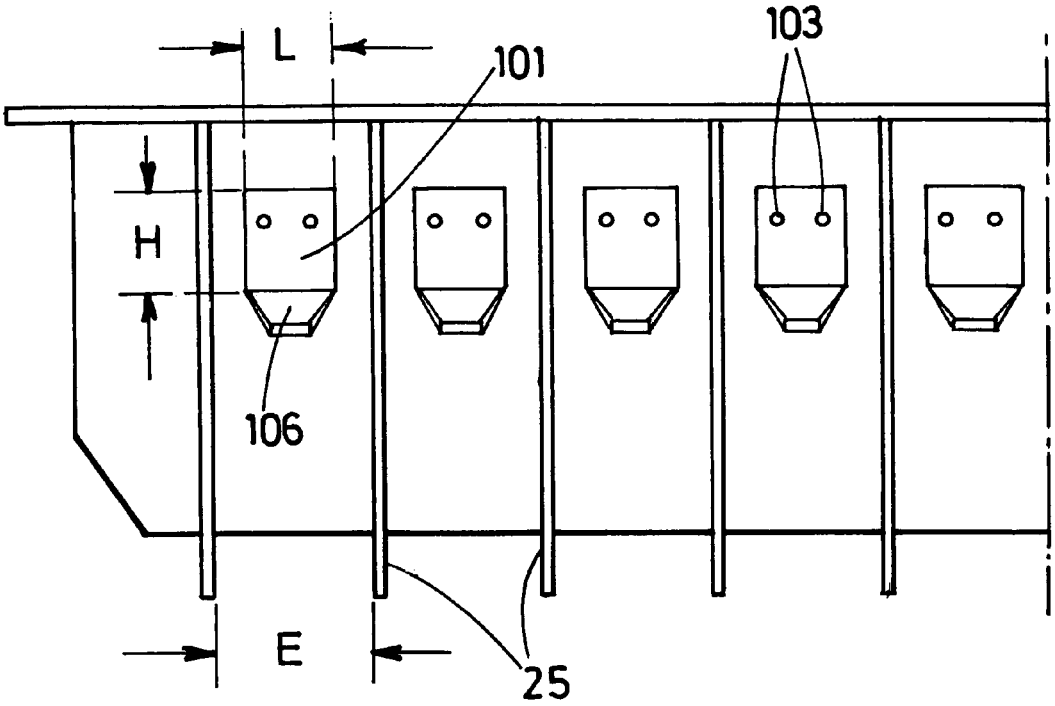
FIG. 5 illustrates schematically along the cross-section AA in FIG. 3 an electrolytic cell equipped with a cooling system according to a preferred embodiment of the invention.

As illustrated in FIG. 1, an electrolytic cell 1 for aluminium production by means of igneous electrolysis typically comprises a pot 20, anodes 7 and alumina feed means 11. The anodes are connected by an anode beam 10 by means of support and attachment means 8, 9. The pot 20 comprises a metal shell 2, typically made of steel, internal lining components 3, 4 and cathode components 5. The internal lining components 3, 4 are generally blocks of refractory materials, which may be, in part or in whole, heat insulators. The cathode components 5 incorporate connection bars (or cathode bars) 6, typically made of steel, to which the electrical conductors used to route the electrolysis current are attached.

The lining components 3, 4 and the cathode components 5 form, inside the pot, a crucible intended to contain the electrolyte bath 13 and a liquid metal pad 12 when the cell is in operation, during which the anodes 7 are partially immersed in the electrolyte bath 13. The electrolyte bath contains dissolved alumina and, as a general rule, an alumina-based covering layer (or crust) 14 covers the electrolyte bath. In some operating modes, the internal lateral walls 3 may be lined with a layer of solidified bath 15. The lining components 3, 4 frequently consists of edge slabs made of carbonaceous material or based on carbonaceous compounds, such as an SiC-base refractory material and lining pastes.

The electrolysis current transits in the electrolyte bath 13 via the anode beam 10, the support and attachment means 8, 9, the anodes 7, the cathode components 5 and the cathode bars 6.

The metal aluminium produced during the electrolysis is normally accumulated at the bottom of the pot and a relatively clear interface 19 is established between the liquid metal 12 and the molten cryolite-based bath 13. The position of this bath-metal interface may vary over time: it goes up as the liquid metal is accumulated at the bottom of the pot and it goes down when the liquid metal is removed from the pot.

Several electrolytic cells are generally arranged in a line, in buildings called electrolysis potrooms, and connected electrically in series using connecting conductors. More specifically, the cathode bars 6 of a so-called "upstream" pot are connected electrically to the anodes 7 of a so-called "downstream" pot, typically via connecting conductors 16, 17, 18 and support and connection means 8, 9, 10 of the anodes 7. The cells are typically arranged so as to form two or more parallel lines. The electrolysis current flows in this way in cascade from one cell to the next.

The anodes 7 are typically made of carbonaceous material, even though that may also consist, in part or in whole, of a so-called "inert" non-consumable material, such as a metal material or ceramic/metal composite (or "cermet").

According to the invention, the method of cooling an electrolytic cell 1 intended for aluminium production by means of igneous electrolysis, said cell 1 comprising a pot 20 comprising a metal shell 2 having lateral walls 21, 22 and at least one bottom wall 23, said pot 20 being intended to contain an electrolyte bath 13 and a liquid metal pad 12, is characterised in that it comprises:

producing heat transfer fluid droplets, placing all or part of said droplets into contact with the shell 2, so as to induce the vaporisation of all or part of said droplets.

The vaporisation of all or part of the heat transfer fluid droplets induces a transfer of heat from the shell to the heat transfer fluid, which makes it possible to remove heat from the shell and cool it.

Preferentially, said droplets are placed in contact with a specified surface 107 of the shell 2, which makes it possible to select the most advantageous surfaces in terms of heat and increase the cooling efficiency of the pot under certain conditions.

The contact with the shell 2 (or a specified surface 107 of the shell) is a thermal contact, in that it makes it possible to remove thermal energy from the shell by means of the vaporisation of all or part of the heat transfer fluid droplets.

The droplets may be placed in contact with the shell and, more specifically, the outer surface of the shell, in different ways, such as by confinement in the vicinity of the shell, by channelling, projection, or a combination of said means.

According to a preferred embodiment of the invention, the method of cooling an electrolytic cell 1 intended for aluminium production by means of igneous electrolysis is characterised in that, in addition, the electrolytic cell 1 is equipped with at least one means 101, referred to as "confinement means", to form a confined space 102 in the vicinity of (or possibly in contact with) a specified surface 107 of at least one of the walls 21, 22, 23 of the shell 2, preferentially at least one of the lateral walls 21, 22 of the shell 2, and in that it comprises the production of heat transfer fluid droplets in said space 102, so as to place all or part of said droplets in contact with said surface 107.

The term "in the vicinity" refers to a distance typically less than 20 cm, or even less than 10 cm.

The confinement of the droplets in a specified volume in the vicinity of a part of the shell, or in contact with said shell, makes it possible to limit and control the diffusion of said droplets.

The droplets are typically produced at a specified distance D from one of the walls 21, 22, 23 of the shell 2, i.e. where the divided heat transfer fluid production zone(s) is/are located at a specified distance D from said wall. The heat transfer fluid is then routed, typically in the liquid state, to the specified distance D. The droplets are preferentially formed in the vicinity of the pot shell in order to prevent the coalescence (or agglomeration) of said droplets before the vaporisation thereof in contact with said wall, i.e. the specified distance is preferentially short (preferentially less than approximately 20 cm, and more preferentially less than 10 cm). Said production zones are typically located in one or more confinement casings 101.

The droplets may be produced continuously or discontinuously. The production rate of said droplets may be variable. The cooling method advantageously comprises the control of the production rate of said droplets. The volume proportion of heat transfer fluid droplets may then be varied in a controlled manner. This alternative embodiment of the invention makes it possible to control the heat extraction from the cell precisely.

Said droplets typically have a size between 0.1 and 5 mm, and preferentially between 1 and 5 mm. Droplets of a size less than approximately 0.1 mm involve the drawback of being easily carried by the movements of the ambient air, or by any evacuation flow of the vaporised droplets, before coming into contact with the shell.

In an advantageous embodiment of the invention, the droplets form a mist or aerosol, preferentially a dense aerosol, in order to favour the vaporisation of the droplets and increase the cooling efficiency.

Said droplets are advantageously produced by spraying said heat transfer fluid, typically using the liquid phase. This spraying may be carried out using at least one nozzle.

The heat transfer fluid is advantageously water since this substance has a very high latent heat of vaporisation. Said water is preferentially purified, in order to reduce its electrical conductivity and limit depositions on the wall of the shell which may, in the long-term, reduce the cooling efficiency. This purification is advantageously carried out, upstream, using a treatment column 113. It typically comprises a water deionisation operation. Preferentially, the purified water contains in total a quantity of ions (anions and cations) less than 10 μg per litre of water and more preferentially less than 1 μg per litre of water.

In a preferred embodiment of the invention, the confinement means 101 comprises at least one casing, i.e. the heat transfer fluid is confined using at least one casing 101. Said casing is placed at a specified distance from the wall of the shell. This embodiment makes it possible to increase the probability of physical contact between said droplets and the surface of the shell (and preferentially a specified surface 107 of the shell), and prevent the dispersion thereof in the area surrounding the pot 20. The confinement casing 101 typically has a specified internal space or volume 102, but it is advantageously open, typically on the side of the shell. It is possible if required to control the droplet formation rate individually in each confinement casing 101.

The confinement means 101 may be contiguous or fixed on the shell 2 or integral therewith.

It is advantageous to position said casing 101 so that it overlaps with the average level of the interface 19 between the electrolyte bath 13 and the liquid metal pad 12, i.e. so as to lie on both sides of the average level of said interface.

The cooling method according to the invention may also comprise evacuation of all or part of the heat transfer fluid vapour formed by the vaporisation of all or part of said droplets in contact with the shell 2 (and particularly in contact with said specified surface 107). This evacuation may be carried out by means of natural ventilation, by suction or blowing, or a combination of said means. The heat transfer fluid vapour is typically evacuated continuously.

Preferentially, the vaporised heat transfer fluid is channelled (typically by suction or blowing) to a point at a distance from the pots, which may be located in the same potroom or outside said potroom, where the heat transfer fluid may be cooled if required, so as to condense the heat transfer fluid vapour, and reintroduced into the cooling circuit.

Advantageously, when the method comprises evacuation of the heat transfer fluid vapour, the droplets are mixed with a carrier gas in order to facilitate the evacuation of the vaporised heat transfer fluid and favour the evaporation of any heat transfer fluid condensates. The carrier gas may be added to said droplets. The carrier gas may advantageously be used to produce the heat transfer fluid droplets by spraying. To this end, the carrier gas may be routed in compressed form. The carrier gas is typically air, but it is possible, within the scope of the invention, to use other gases or gas mixtures.

In a preferred embodiment of the invention, the method comprises the circulation of a heat transfer fluid, in an open or closed circuit, comprising:

a first part for the heat transfer fluid supply, i.e. to provide and route the heat transfer fluid, typically in the liquid state, to the droplet production zone(s);

a second part for the heat transfer fluid droplet formation, typically in said confined space, and to place the divided heat transfer fluid in contact with the shell, so as to induce its complete or partial vaporisation;

a third part for the evacuation of the vaporised heat transfer fluid.

In practice, the evacuated heat transfer fluid typically comprises vapour and some non-vaporised fine droplets. It may possibly contain a liquid condensate of said heat transfer fluid recovered at a distance from the shell.

According to the invention, the cooling system 100 of an electrolytic cell 1 intended for aluminium production by means of igneous electrolysis, said cell 1 comprising a pot 20 comprising a metal shell 2 having lateral walls 21, 22 and at least one bottom wall 23, said pot 20 being intended to contain an electrolyte bath 13 and a liquid metal pad 12, is characterised in that it comprises at least one means 103 to produce heat transfer fluid droplets, typically in the vicinity of the shell 2 of the cell 1, and one means 101 to place all or part of said droplets in contact with the shell 2, so as to induce the vaporisation of all or part of said droplets.

In a preferred embodiment of the invention, the cooling system 100 of an electrolytic cell 1 intended for aluminium production by means of igneous electrolysis is characterised in that it also comprises:

at least one confinement casing 101 at a specified distance from at least one of the walls 21, 22, 23 of the shell 2, heat transfer fluid supply means 105, 111, 112, 113, 114, at least one means 103 to produce heat transfer fluid droplets in said casing, so as to place all or part of said droplets in contact with the shell 2.

The confinement casings 101 are typically in the vicinity of the walls 21, 22, 23 of the shell 2 or, possibly, in contact with the shell 2. They are advantageously placed in the vicinity of, or in contact with, at least one of the lateral walls 21, 22 of said shell 2. The term "in the vicinity" refers to a specified distance typically less than 20 cm, or less than 10 cm.

The confinement casings 101 may be contiguous or fixed on the shell 2 or integral therewith.

Each confinement casing 101 forms a confined space 102 typically corresponding to a specified internal volume. The confinement casing 101 is advantageously open, typically on the side of the shell 2, so as to favour heat exchanges between the shell and the droplets. The confinement casing 101 may possibly be open, particularly, in its upper part 101*a* and/or in its lower part 101*b*.

Said system advantageously comprises a plurality of confinement casings 101 distributed around the shell 2 and, preferentially, on the lateral walls 21, 22 of the shell 2. Each confinement casing 101 is advantageously positioned so as to overlap with the average level of the interface 19 between the electrolyte bath 13 and the liquid metal pad 12. In this case, each casing is typically positioned in a substantially symmetric manner with respect to the average level of the interface (the height H1 above the average level 19 and the height H2 above the average level 19 are in this case substantially equal).

The average depth P of the confinement casings 101 is typically less than 20 cm. The height H of the casings, on the side of the surface 107, is typically between 20 cm and 100 cm, or between 20 cm and 80 cm. The width L of the confinement casings 101 may be less than or equal to the spacing E between the stiffeners 25; they may also be incorporated in, or incorporate, said stiffeners. The specified surface area 107 covered by the casings is typically between 0.2 and 1 $m^2$, and more typically between 0.3 and 0.5 $m^2$.

The means 103 to produce the droplets is advantageously a spraying means. This means typically comprises at least one nozzle, such as an aerosol nozzle.

The confinement casings may comprise one or more means 103 to produce droplets.

The offset ΔH between the spraying means 103 and the average level 19 of the metal bath interface may be positive, zero or negative, i.e. the nozzle may be located above or below the interface level or at the same level as said interface.

The heat transfer fluid supply means 105, 111, 112, 113, 114 typically comprise routing means 105, 111, 112, 114, such as conduits, and a treatment column 113. The routing means typically comprise a distribution conduit 111, an electrically insulating conduit 112 and a heat transfer fluid supply conduit 114.

Advantageously, the system according to the invention also comprises at least one means 104, 110, such as a conduit, to supply each confinement casing 101 with carrier gas, possibly pressurised. Preferentially, it also comprises a means 108, such as a mixer, to produce said droplets using said carrier gas.

The cooling system according to the invention advantageously comprises at least one means 109 to control the heat transfer fluid droplet production rate.

The cooling system according to the invention advantageously comprises means 106, 120, 121, 122, 123, 124 to evacuate all or part of the vaporised heat transfer fluid in contact with the shell 2. The evacuation means make it possible to evacuate the heat transfer fluid vapour formed by the vaporisation of all or part of said droplets coming into contact with said surface 107.

The evacuation means 106, 120, 121, 122, 123, 124, which typically comprise channelling means, are capable of evacuating all or part of the heat transfer fluid vapour after evaporation or vaporisation of all or part of said droplets in contact with the shell 2. In particular, said evacuation means typically comprise evacuation conduits 106, 120, 121, 124 and a suction or blowing means 123. The evacuation conduits typically comprise a manifold conduit 120, an electrically insulating conduit 121 and an outlet conduit 124. The suction and blowing means 123 is typically a fan. These means may also comprise a condenser 122 to condense the suspended heat transfer fluid droplets. This condensation particularly makes it possible to recover the heat transfer fluid and reintroduce it into the cooling circuit. The condenser may advantageously comprise cooling means of the condensed heat transfer fluid in order to be able to reintroduce it into the cooling circuit at a specified temperature, which is generally markedly lower than the vaporisation temperature. It is advantageous to provide means to favour the flow and evacuation of any heat transfer fluid condensates, such as a sloping of some evacuation conduits (particularly in the manifold conduit 120). The evacuation conduits may comprise a collector 106, which may be positioned in the upper part 101*a* or lower part 101*b* of the casings.

The applicant estimates that the number of confinement casings required for a 350 kA pot is typically between approximately 30 and 60. The quantity of heat transfer fluid to be supplied to each casing is typically between 25 and 125 l/h. It also estimates that the fraction of heat transfer fluid droplets actually evaporated in contact with the shell is between 20 and 60%. The evacuated thermal power is typically between 5 and 25 $kW/m^2$. The applicant also estimates that, if a carrier gas is used, the carrier gas flow rate per casing advantageously is typically between 25 $Nm^3/h$ and 150 $Nm^3/h$.

LIST OF NUMERIC REFERENCES

1 Electrolytic cell
2 Shell
3 Lateral internal lining
4 Base internal lining
5 Cathode components
6 Connection bar or cathode bar
7 Anode
8 Anode support means (typically a multipode)
9 Anode support and attachment means (stem)
10 Anode beam
11 Alumina feed means
12 Liquid metal pad
13 Electrolyte bath
14 Alumina covering layer (or crust)
15 Solidified bath layer
16 Connecting conductor (riser)
17 Connecting conductor (collector)
18 Connecting conductor
19 Interface between liquid metal pad and electrolyte bath
20 Pot
21 Lateral wall of shell
22 End lateral wall of shell
23 Bottom wall of shell
25 Shell stiffener
100 Cooling system
101 Confinement casing
101*a* Upper part of confinement casing
101*b* Lower part of confinement casing
102 Confined space
103 Means to produce heat transfer fluid droplets
104 Conduit
105 Conduit
106 Collector
107 Cooling surface
108 Mixer
109 Heat transfer fluid droplet production rate control means
110 Carrier gas supply conduit
111 Distribution conduit
112 Insulating conduit
113 Treatment column
114 Heat transfer fluid supply conduit
120 Manifold conduit
121 Insulating conduit
122 Condenser
123 Suction or blowing means
124 Outlet conduit

The invention claimed is:

1. A method of cooling an electrolytic cell intended for aluminium production by means of igneous electrolysis, said cell comprising a pot comprising a metal shell having lateral walls and at least one bottom wall, said pot being intended to contain an electrolyte bath and a liquid metal pad, said method comprising:

producing heat transfer fluid droplets, placing all or part of said droplets in contact with the shell, so as to induce vaporisation of all or part of said droplets.

2. A method according to claim 1, wherein said droplets are placed in contact with the shell by confinement in the vicinity of the shell, by channelling, projection, or a combination thereof.

3. A method according to claim 1, wherein said droplets are placed in contact with a specified surface of the shell.

4. A method according to claim 1, wherein the electrolytic cell is also equipped with at least one confinement means to form a confined space in the vicinity of, or in contact with, a specified surface of at least one of the walls of the shell, and wherein said method further comprises the production of heat transfer fluid droplets in said space, so as to place all or part of said droplets in contact with said surface.

5. A method according to claim 4, wherein the confinement means forms a confined space in the vicinity of, or in contact with, a specified surface of at least one of the lateral walls of the shell.

6. A method according to claim 4, wherein the confinement means is contiguous or fixed to the shell or integral therewith.

7. A method according to claim 1, wherein said droplets are produced by spraying said heat transfer fluid.

8. A method according to claim 7, wherein at least one nozzle is used to carry out said spraying.

9. A method according to claim 1, wherein said heat transfer fluid is water.

10. A method according to claim 9, wherein the water is purified.

11. A method according to claim 1, wherein said droplets are mixed with a carrier gas.

12. A method according to claim 11, carrier gas is used to produce said droplets by spraying.

13. A method according to claim 11, wherein said carrier gas is air.

14. A method according to claim 1, further comprising controlling the heat transfer fluid droplet production rate.

15. A method according to claim 1, wherein said droplets have a size between 0.1 and 5 mm.

16. A method according to claim 1, wherein the droplets form a mist or aerosol.

17. A method according to claim 1, wherein the droplets are produced at a specified distance D from a wall of the shell less than 20 cm, so as to limit the coalescence of said droplets before vaporisation in contact with said wall.

18. A method according to claim 1 , wherein the confinement means comprises at least one casing.

19. A method according to claim 18, wherein said casing is positioned so that said casing overlaps with an average level of interface between the electrolyte bath and the liquid metal pad.

20. A method according to claim 1, further comprising evacuating all or part of heat transfer fluid vapour formed by the vaporisation of all or part of said droplets upon contacting the shell.

21. A method according to claim 20, wherein said vapour is evacuated by natural ventilation, by suction or blowing, or a combination thereof.

22. A system of an electrolytic cell intended for aluminium production by means of igneous electrolysis, said cell comprising a pot comprising a metal shell having lateral walls and a bottom wall, said pot being intended to contain an electrolyte bath and a liquid metal pad, wherein said system comprises at least one means to produce heat transfer fluid droplets and a means to place all or part of said droplets in contact with the shell, so as to induce the vaporisation of all or part of said droplets.

23. A system according to claim 22, further comprising:

at least one confinement casing at a specified distance from at least one wall of the shell, heat transfer fluid supply means, at least one means to produce heat transfer fluid droplets in said casing, so as to place all or part of said droplets in contact with the shell.

24. A system according to claim 23, wherein each confinement casing is at a specified distance from at least one lateral wall of the shell less than 20 cm.

25. A system according to claim 23, wherein each confinement casing is positioned so as to overlap with an average level of an interface between the electrolyte bath and the liquid metal pad.

26. A system according to claim 23, comprising a plurality of confinement casings distributed around the shell.

27. A system according to claim 23, wherein the heat transfer fluid supply means comprise routing means and a treatment column.

28. A system according to claim 22, wherein said means to produce droplets is a spraying means.

29. A system according to claim 28, wherein the spraying means comprises at least one nozzle.

30. A system according to claim 29, wherein said nozzle is an aerosol nozzle.

31. A system according to claim 22, further comprising at least one means to supply each confinement casing with carrier gas.

32. A system according to claim 31, further comprising a means to produce said droplets using said carrier gas.

33. A system according to claim 22, further comprising at least one means to control the production rate of said droplets.

34. A system according to claim 22, further comprising means to evacuate all or part of vaporised heat transfer fluid.

35. A system according to claim 34, wherein the evacuation means comprise evacuation conduits and a suction or blowing means.

36. A system according to claim 34, wherein the evacuation means comprise a condenser to condense the suspended heat transfer fluid.

37. A method for cooling an igneous electrolysis aluminium production cell comprising using a method of claim 1.

38. A method for cooling an igneous electrolysis aluminium production cell comprising using a system of claim 22.

39. A method to regulate an electrolytic cell intended for aluminium production by means of igneous electrolysis comprising a method according to claim 1.

40. An electrolytic cell intended for aluminium production by means of igneous electrolysis comprising a cooling system according to claim 22.

* * * * *